US012221665B2

(12) United States Patent
Yamamura et al.

(10) Patent No.: US 12,221,665 B2
(45) Date of Patent: Feb. 11, 2025

(54) AUSTENITIC STAINLESS STEEL MATERIAL

(71) Applicant: NIPPON STEEL CORPORATION, Tokyo (JP)

(72) Inventors: Misaho Yamamura, Tokyo (JP); Jun Nakamura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 617 days.

(21) Appl. No.: 17/595,174

(22) PCT Filed: May 29, 2020

(86) PCT No.: PCT/JP2020/021422

§ 371 (c)(1),
(2) Date: Nov. 10, 2021

(87) PCT Pub. No.: WO2020/241851

PCT Pub. Date: Dec. 3, 2020

(65) Prior Publication Data

US 2022/0213571 A1 Jul. 7, 2022

(30) Foreign Application Priority Data

May 31, 2019 (JP) ..... 2019-102577

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C21D 1/18; C21D 2211/001; C21D 2211/004; C21D 6/004; C21D 6/005;
(Continued)

(56) References Cited

U.S. PATENT DOCUMENTS

2006/0193743 A1* 8/2006 Semba ..... C22C 38/02 420/53
2008/0308198 A1 12/2008 Yonezawa et al.
(Continued)

FOREIGN PATENT DOCUMENTS

JP 08013095 A 1/1996
JP 2004339569 * 12/2004
(Continued)

*Primary Examiner* — Nicholas A Wang
(74) *Attorney, Agent, or Firm* — Greer, Burns & Crain, Ltd.

(57) ABSTRACT

In the austenitic stainless steel material of the present disclosure, the chemical composition consists of, by mass %, C: 0.100% or less, Si: 1.00% or less, Mn: 5.00% or less, Cr: 15.00 to 22.00%, Ni: 10.00 to 21.00%, Mo: 1.20 to 4.50%, P: 0.050% or less, S: 0.050% or less, Al: 0.100% or less, N: 0.100% or less, and Cu: 0 to 0.70%, with the balance being Fe and impurities, and an austenite grain size No. determined in accordance with ASTM E112 is from 5.0 to less than 8.0, and in a cross section perpendicular to the longitudinal direction of the austenitic stainless steel material, the dislocation cell structure ratio is from 50 to less than 80%, and the number density of precipitates with a long axis of 1.0 μm or more is 5.0 per 0.2 $mm^2$ or less.

16 Claims, 4 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/58*** | (2006.01) |

(52) U.S. Cl.
CPC ..... *C21D 8/0205* (2013.01); *C21D 8/0226* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/58* (2013.01); *C21D 2211/001* (2013.01)

(58) Field of Classification Search
CPC .... C21D 6/008; C21D 8/0205; C21D 8/0221; C21D 8/0226; C21D 8/0236; C21D 8/0263; C21D 8/065; C21D 8/105; C21D 9/46
See application file for complete search history.

(56) References Cited

U.S. PATENT DOCUMENTS

| | | | |
|---|---|---|---|
| 2017/0029911 | A1 | 2/2017 | Dan et al. |
| 2017/0314092 | A1 | 11/2017 | Nakamura et al. |

FOREIGN PATENT DOCUMENTS

| | | | |
|---|---|---|---|
| JP | 2009079240 | A | 4/2009 |
| WO | 2004111285 | A1 | 12/2004 |
| WO | 2005068674 | A1 | 7/2005 |
| WO | 2015159554 | A1 | 10/2015 |
| WO | 2016068009 | A1 | 5/2016 |

* cited by examiner

AUSTENITIC STAINLESS STEEL MATERIAL

TECHNICAL FIELD

The present disclosure relates to an austenitic stainless steel material.

BACKGROUND ART

In recent years, the development of fuel cell powered vehicles that run on hydrogen as fuel, and also research into the practical use of hydrogen stations where fuel cell powered vehicles are supplied with hydrogen have been progressing. A stainless steel material is one of the candidate materials for utilization for these purposes. However, in a high-pressure hydrogen gas environment, the hydrogen gas may cause embrittlement (hydrogen brittleness) in even a stainless steel material. According to the standards of compressed hydrogen containers for automobiles provided for in the High Pressure Gas Safety Act, the use of SUS316L is approved as a stainless steel material that is excellent in hydrogen brittleness resistance.

However, in consideration of reducing the weight of fuel cell powered vehicles, downsizing hydrogen stations, and the need to perform operations under high pressure in a hydrogen station, it is desirable that a stainless steel material for use in containers or joints and pipes is excellent in hydrogen brittleness resistance in a hydrogen gas environment and has a high strength that is equal to or greater than the strength of the existing SUS316L.

International Application Publication No. WO2016/068009 (Patent Literature 1) proposes an austenitic stainless steel that is excellent in hydrogen brittleness resistance and has high strength.

The austenitic stainless steel disclosed in Patent Literature 1 has a chemical composition consisting of, by mass %, C: 0.10% or less, Si: 1.0% or less, Mn: 3.0% or more and less than 7.0%, Cr: 15 to 30%, Ni: 12.0% or more and less than 17.0%, Al: 0.10% or less, N: 0.10 to 0.50%, P: 0.050% or less, S: 0.050% or less, at least one of V: 0.01 to 1.0% and Nb: 0.01 to 0.50%, Mo: 0 to 3.0%, W: 0 to 6.0%, Ti: 0 to 0.5%, Zr: 0 to 0.5%, Hf: 0 to 0.3%, Ta: 0 to 0.6%, B: 0 to 0.020%, Cu: 0 to 5.0%, Co: 0 to 10.0%, Mg: 0 to 0.0050%, Ca: 0 to 0.0050%, La: 0 to 0.20%, Ce: 0 to 0.20%, Y: 0 to 0.40%, Sm: 0 to 0.40%, Pr: 0 to 0.40%, Nd: 0 to 0.50%, and the balance: Fe and impurities, in which the ratio of the minor axis to the major axis of austenite grains is greater than 0.1, the grain size number of the austenite grains is 8.0 or more, and the tensile strength is 1000 MPa or more.

CITATION LIST

Patent Literature

Patent Literature 1: International Application Publication No. WO2016/068009

SUMMARY OF INVENTION

Technical Problem

In the austenitic stainless steel disclosed in Patent Literature 1, the hydrogen brittleness resistance is increased by making the content of Ni 12.0% or more. In addition, as a result of carbo-nitrides finely precipitating, deformation of crystal grains is suppressed by the pinning effect and the crystal grains are refined. By this means, a high tensile strength is obtained.

However, the austenitic stainless steel disclosed in Patent Literature 1 contains a large amount of alloying elements for forming carbides and carbo-nitrides such as V and Nb in order to utilize the pinning effect. Consequently, the production cost increases. Therefore, it is useful to provide an austenitic stainless steel material that is excellent in hydrogen brittleness resistance and has high strength by means other than the means disclosed in Patent Literature 1.

An objective of the present disclosure is to provide an austenitic stainless steel material that has high tensile strength and is excellent in hydrogen brittleness resistance.

Solution to Problem

An austenitic stainless steel material according to the present disclosure has a chemical composition consisting of, by mass %, C: 0.100% or less,
Si: 1.00% or less,
Mn: 5.00% or less,
Cr: 15.00 to 22.00%,
Ni: 10.00 to 21.00%,
Mo: 1.20 to 4.50%,
P: 0.050% or less,
S: 0.050% or less,
Al: 0.100% or less,
N: 0.100% or less, and
Cu: 0 to 0.70%,
with the balance being Fe and impurities,
wherein:

an austenite grain size No. determined in accordance with ASTM E112 is within a range of 5.0 to less than 8.0, and in a cross section perpendicular to a longitudinal direction of the austenitic stainless steel material, a dislocation cell structure ratio is within a range of 50 to less than 80%, and a number density of precipitates with a long axis of 1.0 μm or more is 5.0 per 0.2 $mm^2$ or less.

Advantageous Effect of Invention

The austenitic stainless steel material according to the present disclosure has high tensile strength and is excellent in hydrogen brittleness resistance.

DESCRIPTION OF EMBODIMENTS

The present inventors conducted studies with regard to an austenitic stainless steel material that has high tensile strength and is excellent in hydrogen brittleness resistance. Containing Cr, Ni and Mo in a steel material is very effective for increasing hydrogen brittleness resistance. Therefore, the present inventors conducted studies regarding the chemical composition of an austenitic stainless steel material that is excellent in hydrogen brittleness resistance. As a result, the present inventors concluded that if an austenitic stainless steel material has a chemical composition consisting of, by mass %, C: 0.100% or less, Si: 1.00% or less, Mn: 5.00% or less, Cr: 15.00 to 22.00%, Ni: 10.00 to 21.00%, Mo: 1.20 to 4.50%, P: 0.050% or less, S: 0.050% or less, Al: 0.100% or less, N: 0.100% or less, and Cu: 0 to 0.70%, with the balance being Fe and impurities, sufficient hydrogen brittleness resistance will be obtained.

Therefore, the present inventors conducted further studies regarding the strength of an austenitic stainless steel material having the aforementioned chemical composition. As described in Patent Literature 1, it is considered that the strength will be increased if fine precipitates such as V precipitates or Nb precipitates are formed and the crystal grains are refined by the pinning effect of the fine precipitates. However, in the case of performing cold working, there is a possibility that these precipitates will serve as starting points for hydrogen cracking.

Therefore, the present inventors conducted studies regarding a method for increasing strength without adopting a method that increases strength by the pinning effect of precipitates, but rather increases the strength by a method that is different from the pinning effect of precipitates. As a result, the present inventors found for the first time that, in an austenitic stainless steel material having the aforementioned chemical composition, instead of utilizing the pinning effect of precipitates, a high strength can be obtained by forming a dislocation cell structure.

Figure 1:
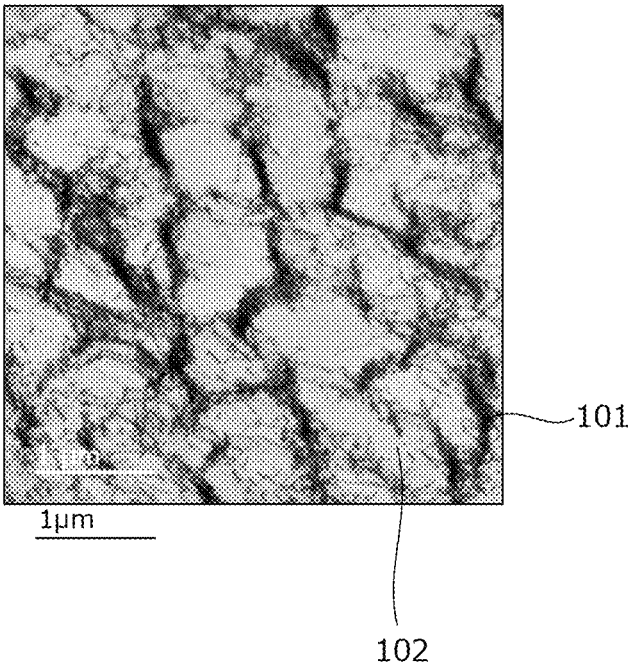
FIG. 1 is a view showing an example of a bright field image (TEM image) of an observation visual field in which a dislocation cell structure has been formed that was obtained by transmission electron microscope observation, in an austenitic stainless steel material having the chemical composition of the present embodiment.
Figure 2:
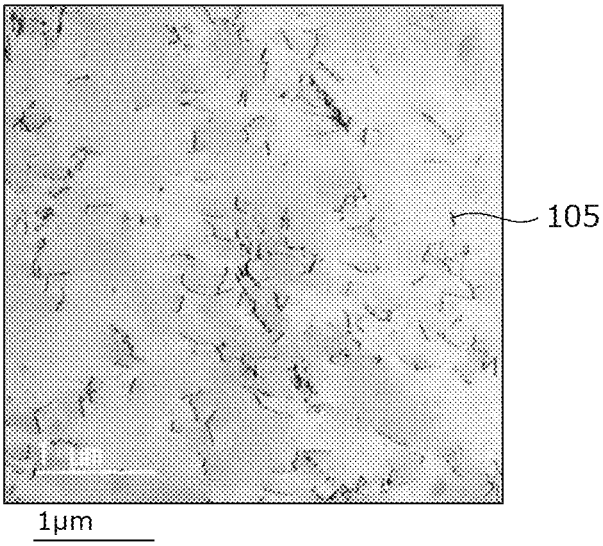
FIG. 2 is a view showing an example of a TEM image in which a dislocation cell structure has not been formed in an austenitic stainless steel material having the chemical composition of the present embodiment.
Figure 3:
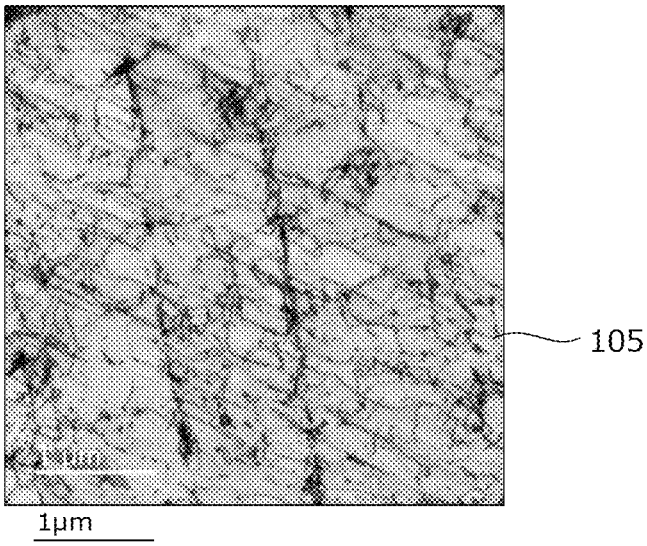
FIG. 3 is a view showing an example of a TEM image, which is different from FIG. 2, in which a dislocation cell structure has not been formed in an austenitic stainless steel material having the chemical composition of the present embodiment.

FIG. 1 is a view showing a bright field image (hereinafter, referred to as a "TEM image") of a visual field (4.2 μm×4.2 μm) obtained by structural observation using a transmission electron microscope (TEM) of an austenitic stainless steel material having the aforementioned chemical composition, in which a dislocation cell structure has been formed. FIG. 2 and FIG. 3 are views illustrating examples of TEM images in which a dislocation cell structure has not been formed in an austenitic stainless steel material having the aforementioned chemical composition. FIG. 1 corresponds to Test Number 1 of the examples that are described later. FIG. 2 corresponds to Test Number 16. FIG. 3 corresponds to Test Number 12.

Each of FIG. 1 to FIG. 3 is a TEM image of an austenitic stainless steel material having the aforementioned chemical composition. In FIG. 2, although short dislocations 105 are present in a sparse manner, the dislocations 105 have not formed cells. Further, in FIG. 3, although a large number of dislocations 105 are present, the dislocations 105 have not formed cells.

On the other hand, the state of the dislocations in the TEM image shown in FIG. 1 differs in comparison to FIG. 2 and FIG. 3. Specifically, cell wall regions 101 in which the dislocation density is high (regions in which the brightness is low (black color) in the TEM image), and low-density dislocation regions 102 that are regions in which the dislocation density is low (regions in which the brightness is high in the TEM image) that are surrounded by cell wall regions 101 are present in FIG. 1. In FIG. 1, the cell wall regions 101 are formed in a mesh shape. The low-density dislocation regions 102 are surrounded by the cell wall regions 101. In the present description, a structure in which the mesh-like cell wall regions 101 and the low-density dislocation regions 102 are present is referred to as a "dislocation cell structure". More specifically, as will be described later, in a case where, in a visual field with a size of 4.2 μm×4.2 μm in a cross section perpendicular to the longitudinal direction of the austenitic stainless steel material, the cell wall regions 101 and the low-density dislocation regions 102 are present and there are nine or more of the low-density dislocation regions 102 with an area of 20 $\mu m^2$ or more, the visual field in question is recognized as a visual field in which a "dislocation cell structure" is formed.

The present inventors found that, in an austenitic stainless steel material having the aforementioned chemical composition, by making austenite grains have a grain size number of 5.0 or more as determined in accordance with ASTM E112, and forming a dislocation cell structure, a high strength is obtained even without utilizing the pinning effect of precipitates. More specifically, the present inventors found that if a dislocation cell structure ratio defined by the following method is 50% or more, excellent hydrogen brittleness resistance and high tensile strength are obtained.

The dislocation cell structure ratio is defined by the following method.

In a cross section perpendicular to the longitudinal direction of an austenitic stainless steel material, an arbitrary 30 visual fields which each have a size of 4.2 μm×4.2 μm are selected. A bright field image (TEM image) is generated by a transmission electron microscope (TEM) in each of the selected visual fields. In each generated TEM image, cell wall regions 101 in which the dislocation density is high, and low-density dislocation regions 102 surrounded by the cell wall regions 101 in which the dislocation density is low are identified. Among the respective visual fields, a visual field in which there are nine or more low-density dislocation regions 102 having an area of 0.20 $\mu m^2$ or more among the identified plurality of low-density dislocation regions 102 is recognized as a visual field in which a dislocation cell structure is formed. The ratio of the number of visual fields in which a dislocation cell structure is formed with respect to all of the visual fields (30 visual fields) is defined as the dislocation cell structure ratio (%).

More specifically, the dislocation cell structure ratio is determined by the following method. Three samples are collected from a cross section perpendicular to the longitudinal direction of the austenitic stainless steel material. A cross section that is perpendicular to the longitudinal direction of the austenitic stainless steel material is adopted as the surface to be examined of each sample. Wet polishing is performed until the thickness of each sample becomes 30 μm. After wet polishing, the sample is subjected to electropolishing using a mixed solution of perchloric acid (10 vol. %) and ethanol (90 vol. %) to prepare a thin film sample. Structural observation of the surface to be examined of each thin film sample is performed using a TEM. Specifically, an arbitrary 10 visual fields on the surface to be examined of each sample are subjected to TEM observation. The size of each visual field is set as a rectangle of 4.2 μm×4.2 μm. The acceleration voltage during the TEM observation is set to 200 kV. Grains that are observable using an incident electron beam in a <110> direction are taken as the observation target. A bright field image (TEM image) is acquired in each visual field.

Figure 4:
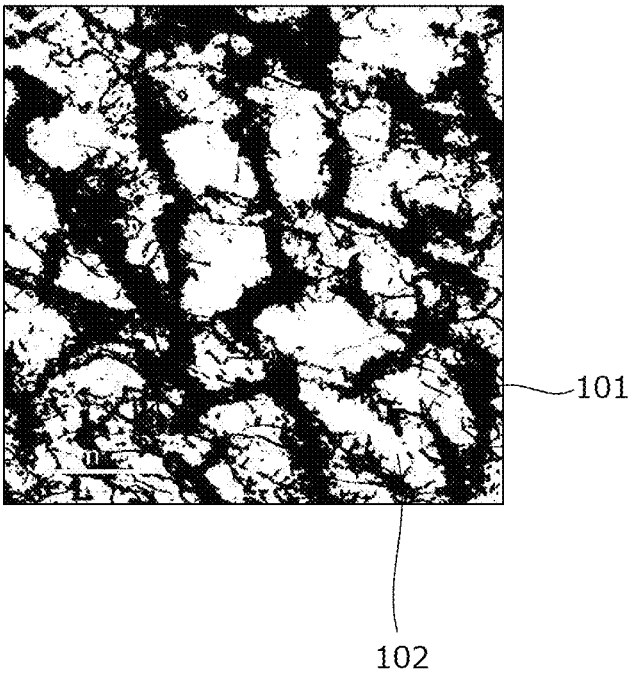
FIG. 4 is an image obtained by binarizing the bright field image shown in FIG. 1 by taking a median value of a histogram of pixel values as a threshold value.

The bright field image (TEM image) of each visual field is used to determine whether or not the visual field is a dislocation cell structure by the following method. In the following description, a method for determining a dislocation cell structure is described by adopting the bright field image (TEM image) shown in FIG. 1 as an example. A histogram showing the frequency of pixel values (0 to 255) in the bright field image (TEM image) is generated, and a median value of the histogram is determined. Note that, the number of picture elements of the bright field image of each visual field is not particularly limited, and for example is set to within a range from 100,000 picture elements or more to 150,000 picture elements or less. The bright field image is then binarized by adopting the median value as a threshold value. FIG. 4 shows an image obtained by binarizing the bright field image of FIG. 1 by taking the median value of a histogram of the pixel values as the threshold value. In the binarized image, black-colored regions are regions in which the dislocation density is high. Therefore, the black-colored regions are recognized as cell wall regions 101. On the other hand, white-colored regions are regions in which the dislocation density is low. Therefore, a white-colored closed region that is surrounded by the cell wall regions 101 is defined as the low-density dislocation region 102.

The outer extent of each white-colored closed region (low-density dislocation region 102) is defined, and the area of each low-density dislocation region 102 is determined. Further, each low-density dislocation region 102 having an area of 0.20 $\mu m^2$ or more is recognized as a "dislocation cell".

Figure 5:
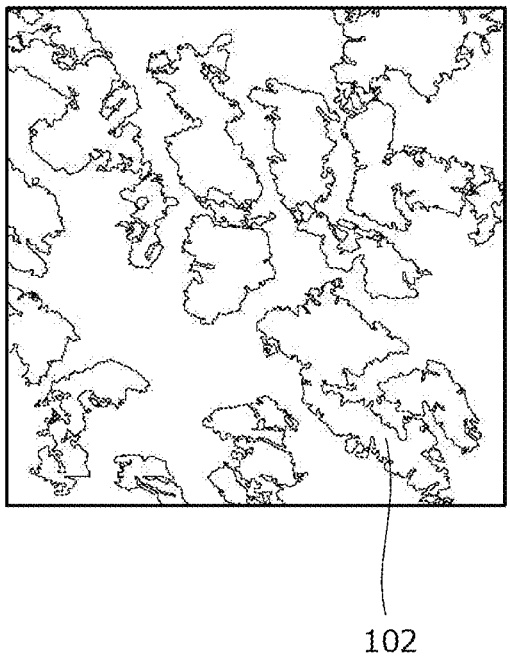
FIG. 5 is a view obtained by rendering and extracting the outer extent of low-density dislocation regions (dislocation cells) having an area of 0.20 $\mu m^2$ or more, based on the binarized image shown in FIG. 4.

FIG. 5 is a view in which, based on the binarized image shown in FIG. 4, the outer extent of the low-density dislocation regions 102 having an area of 0.20 $\mu m^2$ or more (dislocation cells) have been rendered and extracted. In FIG. 5, in a case where the outer extents of respective low-density dislocation regions 102 are in contact with each other, the areas of the low-density dislocation regions 102 in question are calculated as being the area of a single low-density dislocation region 102. In the case of the visual fields of FIG. 1, there are 11 low-density dislocation regions 102.

Note that, when the number of low-density dislocation regions 102 is determined by a similar method with respect to FIG. 2 and FIG. 3 also using the method described above, the number of low-density dislocation regions 102 in FIG. 2 will be two, and the number of low-density dislocation regions 102 in FIG. 3 will be four.

The number of dislocation cells (low-density dislocation regions 102 having an area of 0.20 $\mu m^2$ or more) in each visual field (4.2 μm×4.2 μm) is determined by the above analysis method. Further, in the respective visual fields, if nine or more dislocation cells are present, the visual field in question is recognized as being a visual field in which a dislocation cell structure is formed. Note that, in the respective visual fields, in a case where three or more straight lines which intersect both of the opposite two sides (opposite sides) of the visual field (rectangular bright field image with a size of 4.2 μm×4.2 μm) are present, the visual field in question is recognized as being a planar structure, and is not recognized as a dislocation cell structure. The number of visual fields in which a dislocation cell structure is formed among the observed 30 visual fields is determined. The dislocation cell structure ratio (%) is then defined by the following equation.

Dislocation cell structure ratio=number of visual fields in which a dislocation cell structure is formed/total number of visual fields×100

It suffices to utilize well-known image processing software to calculate the median value of the histogram of pixel values of the aforementioned photographic image (bright field image), to perform binarization processing of the photographic image, to identify the outer extent of each low-density dislocation region 102, and to calculate the area of each low-density dislocation region 102, respectively. Well-known image processing software is, for example, ImageJ (trade name). Note that, it is well known by persons skilled in the art that similar analysis is also possible utilizing image processing software other than ImageJ.

If an austenitic stainless steel material has the aforementioned chemical composition, and the dislocation cell structure ratio based on the above definition is 50% or more, a high strength will be obtained in the austenitic stainless steel material. Although the reason for this is not clear, the following reason is conceivable. In a dislocation cell structure, at the cell wall regions 101, which are high-density dislocation regions, dislocations are densely entangled with each other. Therefore, it is difficult for dislocations constituting the cell wall regions 101 to move, and the dislocations are fixed. It is considered that, as a result, the strength of the austenitic stainless steel material increases.

Note that, even when the contents of the respective elements in the chemical composition of an austenitic stainless steel material are within the aforementioned ranges, the austenite grain size No. determined in accordance with ASTM E112 is 5.0 or more, and the dislocation cell structure ratio is 50% or more, if a large number of coarse precipitates are present in the steel material, hydrogen will be occluded at the interface between the coarse precipitates and the parent phase (austenite), and the hydrogen brittleness resistance will decrease. Therefore, the present inventors conducted investigations and studies regarding the relation between coarse precipitates and hydrogen brittleness resistance in an austenitic stainless steel material in which the contents of the respective elements in the chemical composition are within the aforementioned ranges, the austenite grain size No. determined in accordance with ASTM E112 is 5.0 or more, and the dislocation cell structure ratio is 50% or more. As a result, the present inventors discovered that, in an austenitic stainless steel material in which the contents of the respective elements in the chemical composition are within the aforementioned ranges, the austenite grain size No. determined in accordance with ASTM E112 is 5.0 or more, and the dislocation cell structure ratio is 50% or more, by making the number density of precipitates with a long axis of 1.0 μm or more 5.0 per 0.2 $mm^2$ or less, excellent hydrogen brittleness resistance and high tensile strength are obtained.

The austenitic stainless steel material of the present embodiment that was completed based on the above findings is as follows.

[1]

An austenitic stainless steel material, having a chemical composition consisting of, by mass %, C: 0.100% or less,
Si: 1.00% or less,
Mn: 5.00% or less,
Cr: 15.00 to 22.00%,
Ni: 10.00 to 21.00%,
Mo: 1.20 to 4.50%,
P: 0.050% or less,
S: 0.050% or less,
Al: 0.100% or less,
N: 0.100% or less, and
Cu: 0 to 0.70%,
with the balance being Fe and impurities,
wherein:
an austenite grain size No. determined in accordance with ASTM E112 is within a range of 5.0 to less than 8.0, and
in a cross section perpendicular to a longitudinal direction of the austenitic stainless steel material, a dislocation cell structure ratio is within a range of 50 to less than 80%, and a number density of precipitates with a long axis of 1.0 μm or more is 5.0 per 0.2 $mm^2$ or less.

[2]

The austenitic stainless steel material according to [1], wherein:
the austenite grain size No. is 5.8 or more.

[3]

The austenitic stainless steel material according to [1] or [2], wherein:
the dislocation cell structure ratio is 55% or more.

[4]

The austenitic stainless steel material according to any one of [1] to [3], wherein:
the number density of precipitates with a long axis of 1.0 μm or more is 4.5 per 0.2 $mm^2$ or less.

[5]

The austenitic stainless steel material according to any one of [1] to [4], wherein,
the chemical composition contains:
Cu: 0.01 to 0.70%.

Hereunder, the austenitic stainless steel material of the present embodiment is described in detail. The symbol "%" in relation to an element means "mass percent" unless specifically stated otherwise.

[Chemical Composition]

The chemical composition of the austenitic stainless steel material of the present embodiment contains the following elements.

C: 0.100% or Less

Carbon (C) is an unavoidable impurity. That is, the content of C is more than 0%. C forms carbides at austenite grain boundaries, and reduces the hydrogen brittleness resistance of the steel material. If the content of C is more than 0.100%, even when the contents of the other elements are within the ranges of the present embodiment, the hydrogen brittleness resistance of the steel material will decrease. Therefore, the content of C is set to 0.100% or less. A preferable upper limit of the content of C is 0.080%, more preferably is 0.070%, more preferably is 0.060%, more preferably is 0.040%, more preferably is 0.035%, more preferably is 0.030%, and further preferably is 0.025%. The content of C is preferably as low as possible. However, if the content of C is excessively reduced, the production cost will increase. Therefore, taking into consideration normal industrial production, a preferable lower limit of the content of C is 0.001%, more preferably is 0.002%, more preferably is 0.005%, more preferably is 0.010%, and further preferably is 0.015%.

Si: 1.00% or Less

Silicon (Si) is unavoidably contained. That is, the content of Si is more than 0%. Si deoxidizes the steel. However, if the content of Si is too high, Si will combine with Ni and Cr or the like and promote formation of sigma (a) phase. If the content of Si is more than 1.00%, even when the contents of the other elements are within the ranges of the present embodiment, the hot workability and toughness of the steel material will decrease due to formation of a phase. Therefore, the content of Si is set to 1.00% or less. A preferable upper limit of the content of Si is 0.90%, more preferably is 0.70%, further preferably is 0.60%, and more preferably is 0.50%. If the content of Si is excessively reduced, the production cost will increase. Therefore, taking into consideration normal industrial production, a preferable lower limit of the content of Si is 0.01%, and more preferably is 0.02%. A preferable lower limit of the content of Si for effectively increasing an action that deoxidizes the steel is 0.10%, and more preferably is 0.20%.

Mn: 5.00% or Less

Manganese (Mn) is unavoidably contained. That is, the content of Mn is more than 0%. Mn stabilizes austenite. However, if the content of Mn is too high, formation of σ-ferrite is promoted. If the content of Mn is more than 5.00%, even when the contents of the other elements are within the ranges of the present embodiment, σ-ferrite will form and the hydrogen brittleness resistance of the steel material will decrease. Therefore, the content of Mn is 5.00% or less. A preferable lower limit of the content of Mn is 0.30%, more preferably is 0.50%, more preferably is 1.00%, more preferably is 1.50%, and further preferably is 1.60%. A preferable upper limit of the content of Mn is 4.80%, more preferably is 4.30%, more preferably is 3.80%, more preferably is 3.30%, and further preferably is 2.95%.

Cr: 15.00 to 22.00%

Chromium (Cr) increases the hydrogen brittleness resistance of the steel material. Cr also promotes formation of a dislocation cell structure. If the content of Cr is less than 15.00%, even when the contents of the other elements are within the ranges of the present embodiment, these effects will not be sufficiently obtained. On the other hand, if the content of Cr is more than 22.00%, even when the contents of the other elements are within the ranges of the present embodiment, coarse carbides such as $M_{23}C_6$-type carbides will form. In such a case, the hydrogen brittleness resistance of the steel material will decrease. Therefore, the content of Cr is set within the range of 15.00 to 22.00%. A preferable lower limit of the content of Cr is 15.50%, more preferably is 16.00%, more preferably is 16.50%, and further preferably is 17.00%. A preferable upper limit of the content of Cr is 21.50%, more preferably is 21.00%, more preferably is 20.50%, more preferably is 20.00%, more preferably is 19.50%, more preferably is 19.00%, and further preferably is 18.50%.

Ni: 10.00 to 21.00%

Nickel (Ni) stabilizes austenite and suppresses the formation of strain-induced martensite. Consequently, the hydrogen brittleness resistance of the steel material increases. If the content of Ni is less than 10.00%, even when the contents of the other elements are within the ranges of the present embodiment, the aforementioned effect will not be sufficiently obtained. On the other hand, if the content of Ni is more than 21.00%, even when the contents of the other elements are within the ranges of the present embodiment, the aforementioned effect will be saturated and the production cost will increase. Therefore, the content of Ni is set within the range of 10.00 to 21.00%. A preferable lower limit of the content of Ni is 10.50%, more preferably is 11.00%, more preferably is 11.50%, more preferably is 12.00%, and further preferably is 12.50%. A preferable upper limit of the content of Ni is 17.50%, more preferably is 17.00%, more preferably is 16.50%, more preferably is 16.00%, more preferably is 15.50%, more preferably is 15.00%, and further preferably is 14.50%.

Mo: 1.20 to 4.50%

Molybdenum (Mo) increases the hydrogen brittleness resistance and strength of the steel material. Mo also refines crystal grains and thereby facilitates formation of dislocation cell structures. If the content of Mo is less than 1.20%, even when the contents of the other elements are within the ranges of the present embodiment, these effects will not be obtained. On the other hand, if the content of Mo is more than 4.50%, even when the contents of the other elements are within the ranges of the present embodiment, the effects thereof will be saturated and the production cost will merely increase. Therefore, the content of Mo is set within the range of 1.20 to 4.50%. A preferable lower limit of the content of Mo is 1.30%, more preferably is 1.40%, and further preferably is 1.60%. A preferable upper limit of the content of Mo is 3.50%, more preferably is 3.20%, and further preferably is 3.00%.

P: 0.050% or Less

Phosphorus (P) is an impurity that is unavoidably contained. That is, the content of P is more than 0%. If the content of P is more than 0.050%, even when the contents of the other elements are within the ranges of the present embodiment, the hot workability and toughness of the steel material will decrease. Therefore, the content of P is 0.050% or less. A preferable upper limit of the content of P is 0.045%, more preferably is 0.040%, more preferably is 0.035%, more preferably is 0.030%, and further preferably is 0.025%. The content of P is preferably as low as possible. However, excessively reducing the content of P will increase the production cost. Therefore, taking into consideration normal industrial production, a preferable lower limit of the content of P is 0.001%, and more preferably is 0.005%.

S: 0.050% or Less

Sulfur (S) is an impurity that is unavoidably contained. That is, the content of S is more than 0%. If the content of S is more than 0.050%, even when the contents of the other elements are within the ranges of the present embodiment, the hot workability and toughness of the steel material will decrease. Therefore, the content of S is 0.050% or less. A preferable upper limit of the content of S is 0.030%, and further preferably is 0.025%. The content of S is preferably as low as possible. However, excessively reducing the content of S will increase the production cost. Therefore, taking into consideration normal industrial production, a preferable lower limit of the content of S is 0.001%.

Al: 0.100% or Less

Aluminum (Al) is unavoidably contained. That is, the content of Al is more than 0%. Al deoxidizes the steel. If even a small amount of Al is contained, this effect is obtained to a certain extent. However, if the content of Al is more than 0.100%, even when the contents of the other elements are within the ranges of the present embodiment, oxides and intermetallic compounds will easily form in the steel material, and the toughness of the steel material will decrease. Therefore, the content of Al is set to 0.100% or less. A preferable lower limit of the content of Al for more effectively deoxidizing the steel material is 0.001%, and more preferably is 0.002%. A preferable upper limit of the content of Al is 0.050%, more preferably is 0.040%, and further preferably is 0.030%. In the present description, the term "content of Al" means the content of sol. Al (acid-soluble Al).

N: 0.100% or Less

Nitrogen (N) is unavoidably contained. That is, the content of N is more than 0%. N increases the strength of the steel material. If even a small amount of N is contained, the aforementioned effect is obtained to a certain extent. However, if the content of N is more than 0.100%, even when the contents of the other elements are within the ranges of the present embodiment, coarse nitrides will easily form. Therefore, the content of N is set to 0.100% or less. A preferable lower limit of the content of N is 0.001%, more preferably is 0.005%, and further preferably is 0.010%. A preferable upper limit of the content of N is 0.090%, more preferably is 0.080%, and further preferably is 0.070%.

The balance in the chemical composition of the austenitic stainless steel material according to the present embodiment is Fe and impurities. Here, the term "impurities" refers to elements which, during industrial production of the austenitic stainless steel material of the present embodiment, are mixed in from ore or scrap that is used as a raw material, or from the production environment or the like, and which are allowed within a range that does not adversely affect the austenitic stainless steel material of the present embodiment.

[Regarding Optional Element]

The chemical composition of the austenitic stainless steel material according to the present embodiment may also contain Cu in lieu of a part of Fe.

Cu: 0 to 0.70%

Copper (Cu) is an optional element, and need not be contained. That is, the content of Cu may be 0%. If contained, Cu enhances the corrosion resistance of the steel material. If even a small amount of Cu is contained, the aforementioned effect is obtained to a certain extent. However, if the content of Cu is more than 0.70%, even when the contents of the other elements are within the ranges of the present embodiment, the hot workability of the steel material will decrease. Therefore, the content of Cu is set within the range of 0 to 0.70%. A preferable lower limit of the content of Cu is 0.01%, more preferably is 0.05%, more preferably is 0.10%, more preferably is 0.15%, and further preferably is 0.20%. A preferable upper limit of the content of Cu is 0.65%, more preferably is 0.60%, more preferably is 0.55%, and further preferably is 0.50%.

[Austenite Grain Size No.]

In the austenitic stainless steel material of the present embodiment, the austenite grain size No. determined in accordance with ASTM E112 is within a range of 5.0 to less than 8.0. Here, "ASTM" is an abbreviation of "American Society for Testing and Material".

If the austenite grain size No. is less than 5.0, it will be difficult for dislocation cell structures which are described later to be formed. If dislocation cell structures are not formed, the strength of the austenitic stainless steel material having the aforementioned chemical composition will be low.

If the austenite grain size No. is 5.0 or more, dislocation cell structures will be formed in the austenitic stainless steel material having the aforementioned chemical composition. Specifically, when the austenite grain size No. is 5.0 or more, the crystal grains become fine. Therefore, the dislocations formed in the grains are short. Since it is easy for short dislocations to move, it is easy for the dislocations to become entangled with each other, and consequently it is easy for dislocation cell structures to be formed.

In a steel material having the aforementioned chemical composition, if the austenite grain size No. is 5.0 or more, and in the microstructure, the dislocation cell structure ratio is 50% or more, not only is excellent hydrogen brittleness resistance obtained, but a high strength is also obtained because of the synergetic effect of refinement of the grain size and the dislocation cell structures. A preferable lower limit of the grain size number is 5.5, more preferably is 5.8, more preferably is 5.9, more preferably is 6.0, and further preferably is 6.1.

Note that, the upper limit of the austenite grain size No. is not particularly limited. However, in the case of producing the austenitic stainless steel material by a production method that is described later, the austenite grain size No. will be less than 8.0. Therefore, in the present embodiment, the upper limit of the grain size number of the austenitic stainless steel material is less than 8.0. A preferable upper limit of the grain size number of the austenitic stainless steel material is 7.9, more preferably is 7.8, more preferably is 7.5, and further preferably is 7.0.

Figure 6:
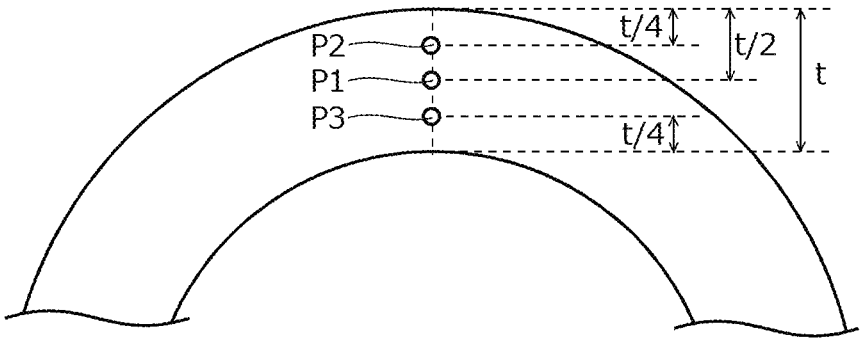
FIG. 6 is a schematic diagram for describing sampling positions in a case where the austenitic stainless steel material of the present embodiment is a pipe.

The austenite grain size No. is determined by the following method. The austenitic stainless steel material is cut perpendicularly to the longitudinal direction. In a case where the austenitic stainless steel material is a pipe, as illustrated in FIG. 6, the wall thickness in a cross section perpendicular to the longitudinal direction of the austenitic stainless steel material is defined as "t" (mm). A t/2 position (that is, the center position of the wall thickness) in the wall thickness direction from the outer surface is defined as a sampling position P1. A t/4 position in the wall thickness direction from the outer surface is defined as a sampling position P2. A t/4 position in the wall thickness direction from the inner surface is defined as a sampling position P3. A sample collected from the sampling position P1 is referred to as "sample P1". A sample collected from the sampling position P2 is referred to as "sample P2". A sample collected from the sampling position P3 is referred to as "sample P3". A cross section perpendicular to the longitudinal direction of the austenitic stainless steel material is adopted as the surface to be examined for each of the samples P1 to P3. The sample P1 is collected in a manner so that the center position of the surface to be examined approximately corresponds to the t/2 position. The sample P2 is collected in a manner so that the center position of the surface to be examined approximately corresponds to the t/4 position. The sample P3 is collected in a manner so that the center position of the surface to be examined approximately corresponds to the t/4 position.

Figure 7:
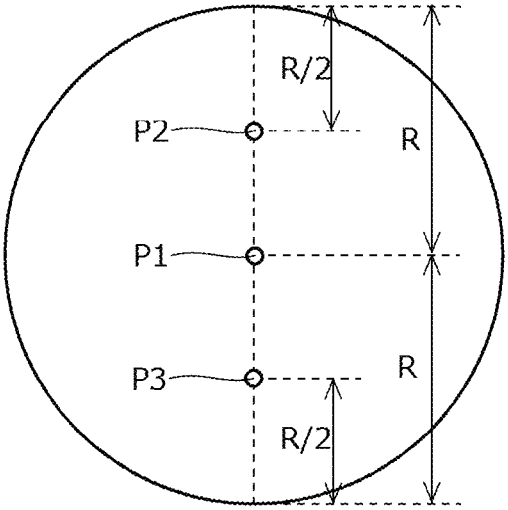
FIG. 7 is a schematic diagram for describing sampling positions in a case where the austenitic stainless steel material of the present embodiment is a steel bar.

In a case where the austenitic stainless steel material is a steel bar, as illustrated in FIG. 7, a radius in a cross section perpendicular to the longitudinal direction of the austenitic stainless steel material is defined as "R" (mm). An R position in the radial direction from the surface, that is, the center position of the cross section perpendicular to the longitudinal direction of the austenitic stainless steel material is defined as a sampling position P1. At a diameter including the center position of the cross section, an R/2 position in the radial direction from the surface at one end of the diameter is defined as a sampling position P2. An R/2 position in the radial direction from the surface at the other end of the diameter is defined as a sampling position P3. Samples P1 to P3 are collected from the sampling positions P1 to P3. A cross section perpendicular to the longitudinal direction of the austenitic stainless steel material is adopted as the surface to be examined for each of the samples P1 to P3. The sample P1 is collected in a manner so that the center position of the surface to be examined corresponds to the center position of the cross section perpendicular to the longitudinal direction of the steel bar. The sample P2 is collected in a manner so that the center position of the surface to be examined approximately corresponds to the R/2 position. The sample P3 is collected in a manner so that the center position of the surface to be examined approximately corresponds to the R/2 position.

Figure 8:
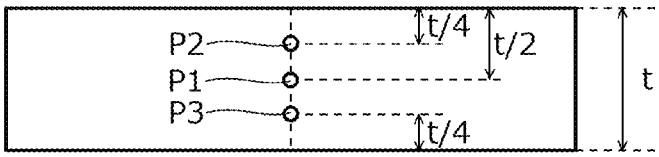
FIG. 8 is a schematic diagram for describing sampling positions in a case where the austenitic stainless steel material of the present embodiment is a steel sheet.

In a case where the austenitic stainless steel material is a steel sheet, as illustrated in FIG. 8, the sheet thickness at a cross section perpendicular to the longitudinal direction of the austenitic stainless steel material is defined as "t" (mm). A t/2 position in the sheet thickness direction from the top surface is defined as a sampling position P1. A t/4 position in the sheet thickness direction from the top surface is defined as a sampling position P2. A t/4 position in the sheet thickness direction from the bottom surface is defined as a sampling position P3. Samples P1 to P3 are collected from the sampling positions P1 to P3. A cross section perpendicular to the longitudinal direction of the austenitic stainless steel material is adopted as the surface to be examined for each of the samples P1 to P3. The sample P1 is collected in a manner so that the center position of the surface to be examined approximately corresponds to the t/2 position. The sample P2 is collected in a manner so that the center position of the surface to be examined approximately corresponds to the t/4 position. The sample P3 is collected in a manner so that the center position of the surface to be examined approximately corresponds to the t/4 position.

The surface to be examined of each of the samples P1 to P3 is mirror-polished. Each surface to be examined that was mirror-polished is then subjected to etching using a mixed acid (solution in which hydrochloric acid and nitric acid are mixed at a ratio of 1:1) to reveal austenite grain boundaries. Structural observation of the surface to be examined of the respective samples P1 to P3 is performed using an optical microscope. The magnification of the optical microscope for the structural observation is set to ×100. An arbitrary three visual fields are selected on the surface to be examined of each of the samples P1 to P3. The size of each visual field is set to 1000 μm×1000 μm. In each visual field, the austenite grain size No. is measured in accordance with ASTM E112. The arithmetic mean value of the respective austenite grain size Nos. obtained in the nine visual fields (three visual fields in each of the samples P1 to P3) is defined as the austenite grain size No. of the austenitic stainless steel material.

[Dislocation Cell Structure]

In the austenitic stainless steel material of the present embodiment, furthermore, the dislocation cell structure ratio in a cross section perpendicular to the longitudinal direction of the austenitic stainless steel material is within a range of 50 to less than 80%. In this case, the dislocation cell structure ratio is defined by the following method.

[Definition of Dislocation Cell Structure Ratio]

An arbitrary 30 visual fields that each have a size of 4.2 μm×4.2 μm are selected in a cross section perpendicular to the longitudinal direction of the austenitic stainless steel material of the present embodiment. A TEM image (bright field image) is generated in each of the selected visual fields. In each generated TEM image, cell wall regions 101 in which the dislocation density is high, and low-density dislocation regions 102 in which the dislocation density is low are identified. Among the respective visual fields, a visual field in which nine or more low-density dislocation regions 102 having an area of 0.20 $\mu m^2$ or more are present among the identified plurality of low-density dislocation regions 102 is recognized as a visual field in which a dislocation cell structure is formed. The ratio of the number of visual fields in which a dislocation cell structure is formed with respect to all of the visual fields (30 visual fields) is defined as the dislocation cell structure ratio (%).

More specifically, the dislocation cell structure ratio is determined by the following method.

[Method for Measuring Dislocation Cell Structure Ratio]

Samples P1 to P3 for dislocation cell structure observation are collected from the aforementioned sampling positions P1 to P3 in a cross section perpendicular to the longitudinal direction of the austenitic stainless steel material. A cross section that is perpendicular to the longitudinal direction of the austenitic stainless steel material is adopted as the surface to be examined of the respective samples P1 to P3. Wet polishing is performed until the thickness of each of the samples P1 to P3 becomes 30 μm. After wet polishing, the respective samples P1 to P3 are subjected to electropolishing using a mixed solution of perchloric acid (10 vol. %) and ethanol (90 vol. %) to prepare thin film samples P1 to P3. The surface to be examined of each of the thin film samples P1 to P3 is subjected to structural observation using a transmission electron microscope (TEM). Specifically, an arbitrary 10 visual fields on the surface to be examined of each sample are subjected to TEM observation. The size of each visual field is set as a rectangle of 4.2 μm×4.2 μm. The acceleration voltage during the TEM observation is set to 200 kV. Grains that are observable using an incident electron beam in a <110> direction are taken as the observation target. A bright field image is generated in each visual field.

The bright field image of each visual field is used to determine whether or not each visual field is a dislocation cell structure by the following method. For each bright field image, a histogram showing the frequency of pixel values (0 to 255) is generated, and a median value of the histogram is determined. Note that, the number of picture elements of the bright field image of each visual field is not particularly limited, and for example is set to within a range from 100,000 picture elements or more to 150,000 picture elements or less. The bright field image is then binarized by adopting the median value as a threshold value. In FIG. 4 that is one example of a binarized image, black-colored regions are regions in which the dislocation density is high. Therefore, the black-colored regions are recognized as cell wall regions 101. On the other hand, white-colored regions are regions in which the dislocation density is low. Therefore, a white-colored closed region that is surrounded by the cell wall regions 101 is defined as the low-density dislocation region 102. The outer extent of each white-colored closed region (low-density dislocation region 102) is defined, and the area of each low-density dislocation region 102 is determined. Then, each low-density dislocation region 102 which has an area of 0.20 $\mu m^2$ or more is recognized as a "dislocation cell".

The number of dislocation cells (low-density dislocation regions 102 having an area of 0.20 $\mu m^2$ or more) in each visual field (4.2 μm×4.2 μm) is determined. Further, in the respective visual fields, if nine or more dislocation cells are present, the visual field in question is recognized as being a visual field in which a dislocation cell structure is formed. Note that, in the respective visual fields, in a case where three or more straight lines which intersect both of the opposite two sides (opposite sides) of the visual field (rectangular bright field image with a size of 4.2 μm×4.2 μm) are present, the visual field in question is recognized as being a planar structure, and is not recognized as a dislocation cell structure. The number of visual fields in which a dislocation cell structure is formed among the observed 30 visual fields is determined. The dislocation cell structure ratio (%) is then defined by the following equation.

Dislocation cell structure ratio=number of visual fields in which a dislocation cell structure is formed/total number of visual fields×100

In the austenitic stainless steel material according to the present embodiment, the dislocation cell structure ratio determined according to the above definition is 50% or more. Therefore, the austenitic stainless steel material according to the present embodiment is not only excellent in hydrogen brittleness resistance, but also has high strength. In the cell wall regions 101, dislocations are densely entangled with each other. Therefore, it is difficult for dislocations constituting the dislocation cell structure to move. It is considered that, as a result, the strength of the austenitic stainless steel material increases.

Although the upper limit of the dislocation cell structure ratio is not particularly limited, it is preferable that the dislocation cell structure ratio is high. However, when the dislocation cell structure ratio is within the range of 50 to less than 80%, excellent hydrogen brittleness resistance and a sufficiently high strength are obtained. A preferable lower limit of the dislocation cell structure ratio is 53%, more preferably is 55%, more preferably is 56%, more preferably is 57%, more preferably is 58%, more preferably is 59%, and further preferably is 60%. The upper limit of the dislocation cell structure ratio may be 79%, may be 78%, may be 77%, may be 75%, may be 72%, may be 70%, or may be 68%.

[Regarding Number Density of Coarse Precipitates in Steel Material]

In the austenitic stainless steel material of the present embodiment, furthermore, in a cross section perpendicular to the longitudinal direction of the austenitic stainless steel material, the number density of precipitates with a long axis of 1.0 μm or more is 5.0 per 0.2 $mm^2$ or less.

In the austenitic stainless steel material having the chemical composition described above, precipitates with a long axis of 1.0 μm or more are defined as "coarse precipitates". The precipitates are carbides, nitrides, carbo-nitrides or the like, and for example are $M_{23}C_6$-type carbides. The coarse precipitates are liable to occlude hydrogen at the interface with the parent phase (austenite). Therefore, if the number of coarse precipitates is large, the hydrogen brittleness resistance of the austenitic stainless steel material will decrease. Note that, compared to the coarse precipitates, it is difficult for hydrogen to be occluded by precipitates with a long axis of less than 1.0 μm. Therefore, the influence which precipitates with a long axis of less than 1.0 μm have on hydrogen brittleness resistance is very small compared to the coarse precipitates. For this reason, in the present embodiment, attention is focused on the coarse precipitates.

If the number of coarse precipitates is greater than 5.0 per 0.2 $mm^2$, even if the contents of the respective elements in the chemical composition of the austenitic stainless steel material are within the ranges of the present embodiment, the austenite grain size No. determined in accordance with ASTM E112 is within a range of 6.0 to less than 8.0, and the dislocation cell structure ratio is within a range of 50 to less than 80%, sufficient hydrogen brittleness resistance will not be obtained. If the number of coarse precipitates is 5.0 per 0.2 $mm^2$ or less, on the premise that the contents of the respective elements in the chemical composition of the austenitic stainless steel material are within the ranges of the present embodiment, the austenite grain size No. determined in accordance with ASTM E112 is within a range of 5.0 to less than 8.0, and the dislocation cell structure ratio is within a range of 50 to less than 80%, excellent hydrogen brittleness resistance will be obtained.

[Method for Measuring Number Density of Coarse Precipitates]

The number density of coarse precipitates can be measured by the following method. Samples for measuring the number density of coarse precipitates are collected from the aforementioned sampling positions P1 to P3. Hereinafter, a sample collected from the sampling position P1 is referred to as "sample P1". A sample collected from the sampling position P2 is referred to as "sample P2". A sample collected from the sampling position P3 is referred to as "sample P3".

Figure 9:
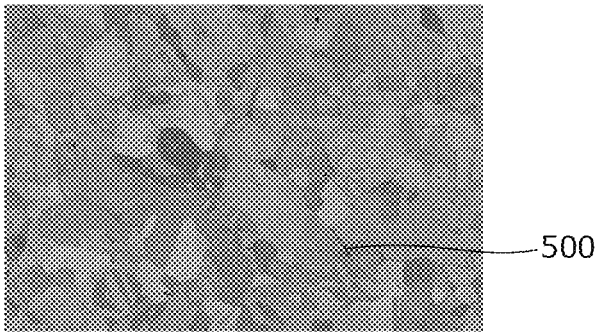
FIG. 9 is a view showing a backscattered electron image of a microstructure including precipitates in an austenitic stainless steel material.

A cross section perpendicular to the longitudinal direction of the austenitic stainless steel material is adopted as the surface to be examined of the respective samples P1 to P3. The surface to be examined is mirror-polished. Each of the samples P1 to P3 after mirror-polishing is then subjected to etching using a mixed acid (solution in which hydrochloric acid and nitric acid are mixed at a ratio of 1:1) to reveal austenite grain boundaries and precipitates. After etching, one visual field of the surface to be examined is observed using a backscattered electron image utilizing a scanning electron microscope (SEM). The visual field size is set to 400 μm×500 μm. Precipitates in the visual field can be identified by contrast. FIG. 9 shows one example of a backscattered electron image. Referring to FIG. 9, a black-colored region 500 in the visual field indicates a precipitate.

The long axis of each precipitate is measured. Specifically, the longest straight line among straight lines connecting any two points at the interface between the precipitate and the parent phase (austenite) is defined as the long axis (μm). Among the precipitates, precipitates with a long axis of 1.0 μm or more are identified as "coarse precipitates". The number of identified coarse precipitates is determined. The number density of coarse precipitates (per 0.2 $mm^2$) in the respective samples P1 to P3 is determined based on the obtained number of coarse precipitates and the visual field area (0.2 $mm^2$). The arithmetic mean value of the three number densities is then defined as the number density of coarse precipitates (per 0.2 $mm^2$).

As described above, in the austenitic stainless steel material of the present embodiment, the contents of the respective elements in the chemical composition are within the aforementioned ranges, the austenite grain size No. determined in accordance with ASTM E112 is within the range of 5.0 to less than 8.0, the dislocation cell structure ratio is within the range of 50 to less than 80%, and the number density of precipitates with a long axis of 1.0 μm or more is 5.0 per 0.2 $mm^2$ or less. Therefore, in the austenitic stainless steel material of the present embodiment, not only is excellent hydrogen brittleness resistance obtained, but high tensile strength is also obtained. A preferable upper limit of the number density of precipitates with a long axis of 1.0 μm or more is 4.7 per 0.2 $mm^2$, more preferably is 4.3 per 0.2 $mm^2$, more preferably is 4.0 per 0.2 $mm^2$, more preferably is 3.7 per 0.2 $mm^2$, more preferably is 3.3 per 0.2 $mm^2$, more preferably is 3.0 per 0.2 $mm^2$, and further preferably is 2.7 per 0.2 $mm^2$.

[Shape of Austenitic Stainless Steel Material of the Present Embodiment]

The shape of the austenitic stainless steel material of the present embodiment is not particularly limited. The austenitic stainless steel material of the present embodiment may be a pipe. The austenitic stainless steel material of the present embodiment may be a steel bar. The austenitic stainless steel material of the present embodiment may be a steel sheet. The austenitic stainless steel material of the present embodiment may be another shape that is other than a pipe, a steel bar, or a steel sheet.

[Applications of Austenitic Stainless Steel Material of Present Embodiment]

The austenitic stainless steel material of the present embodiment can be widely applied to applications in which hydrogen brittleness resistance and high strength are required. In particular, the austenitic stainless steel material of the present embodiment can be utilized in members for high-pressure hydrogen gas environment applications. Such high-pressure hydrogen gas environment applications include, for example, a member to be utilized in a high-pressure hydrogen container that is mounted in a fuel cell powered vehicle, and a member to be utilized in a high-pressure hydrogen container installed at a hydrogen station that supplies hydrogen to fuel cell powered vehicles. However, the austenitic stainless steel material of the present embodiment is not limited to high-pressure hydrogen gas environment applications. As mentioned above, the austenitic stainless steel material of the present embodiment can be widely applied to applications in which hydrogen brittleness resistance and high strength are required.

[Production Method]

A method for producing the austenitic stainless steel material of the present embodiment is described hereinafter. The method for producing an austenitic stainless steel material described hereinafter is one example of a method for producing the austenitic stainless steel material of the present embodiment. Accordingly, an austenitic stainless steel material having the structure described above may be produced by another production method other than the production method described hereinafter. However, the production method described hereinafter is a preferable example of a method for producing the austenitic stainless steel material of the present embodiment.

One example of the method for producing the austenitic stainless steel material of the present embodiment includes a preparation process, a heat treatment process, and a cold working process. Each of these processes is described in detail below.

[Preparation Process]

In the preparation process, an intermediate steel material having the aforementioned chemical composition is prepared. An intermediate steel material purchased from a third party may be utilized as the intermediate steel material having the aforementioned chemical composition. An intermediate steel material that was produced may also be utilized. In the case of producing the intermediate steel material, for example, the intermediate steel material is produced by the following method.

Molten steel having the aforementioned chemical composition is produced by a well-known method. The thus-produced molten steel is used to produce a casting material by a well-known casting process. For example, an ingot is produced by an ingot-making process. A cast piece (a slab, a bloom, a billet or the like) may be produced by a continuous casting process. The ingot may be subjected to hot working such as hot forging or blooming to produce a slab, a bloom or a billet. A starting material is produced by the above process.

The prepared starting material is subjected to hot working (hot working process). The hot working is, for example, hot forging, hot extrusion, or hot rolling. The hot forging is, for example, extend forging. The hot rolling, for example, may be performed by tandem rolling using a tandem rolling mill including a plurality of roll stands (each roll stand having a pair of work rolls) arranged in a row, and multiple pass rolling may be performed, or reverse rolling may be performed by a reverse rolling mill or the like having a pair of work rolls, and multiple pass rolling may be performed. The hot extrusion is, for example, hot extrusion by the Ugine-Sejournet process. An intermediate steel material may be produced by the above production processes. A preferable heating temperature T0 before hot working is 950 to 1100° C. A preferable holding time t0 at the heating temperature T0 is 20 to 150 minutes (2.5 hours). If the heating temperature is more than 1100° C., crystal grains will coarsen. Consequently, even if a heat treatment process and a cold working process are carried out, the austenite grain size No. determined in accordance with ASTM E112 is liable to be less than 5.0.

A preferable reduction of area in the hot working is 50% or more. In this case, a reduction of area (%) is defined by the following equation.

Reduction of area=(1−cross-sectional area perpendicular to longitudinal direction of intermediate steel material after hot working/cross-sectional area perpendicular to longitudinal direction of starting material before hot working)×100

A preferable lower limit of the reduction of area is 55%, and more preferably is 60%. The upper limit of the reduction of area is not particularly limited. Taking the equipment load into consideration, a preferable upper limit of the reduction of area is, for example, 90%.

[Heat Treatment Process]

In the heat treatment process, the intermediate steel material having the aforementioned chemical composition is subjected to a heat treatment. Specifically, the intermediate steel material is held for a holding time t1 at a heat treatment temperature T1 (° C.). Subsequently, after the holding time has passed, the intermediate steel material is rapidly cooled. The rapid cooling is, for example, water cooling or oil cooling. The cooling rate is, 100° C./sec or more. The conditions for the heat treatment temperature T1 (° C.) and the holding time t1 (mins) are as follows.

Heat treatment temperature T1: 950 to 1200 (° C.) Holding time t1 at heat treatment temperature T1: 5 to (1400−T1)/5 (mins)

[Regarding Heat Treatment Temperature T1]

If the heat treatment temperature T1 is less than 950° C., precipitates in the intermediate steel material will not sufficiently dissolve, and will remain in the steel material. In this case, the number density of coarse precipitates will be more than 5.0 per 0.2 $mm^2$. On the other hand, if the heat treatment temperature T1 is more than 1200° C., austenite grains will coarsen, and the austenite grain size No. of the produced austenitic stainless steel material will be less than 5.0. Therefore, the heat treatment temperature T1 is set within the range of 950 to 1200° C. A preferable lower limit of the heat treatment temperature T1 is 980° C., more preferably is 1050° C., and further preferably is 1100° C. A preferable upper limit of the heat treatment temperature T1 is 1180° C.

[Regarding Holding Time t1]

Let F1=(1400−T1)/5. The heat treatment temperature T1 is substituted for "T1" in F1. If the holding time t1 is less than 5 minutes, precipitates in the intermediate steel material will not sufficiently dissolve, and will remain in the steel material. In this case, the number density of coarse precipitates will be more than 5.0 per 0.2 $mm^2$. On the other hand, if the holding time t1 is more than (1400−T1)/5 minutes, the dislocation cell structure ratio will be less than 50%. Therefore, the holding time t1 at the heat treatment temperature T1 is set within the range of 5 to (1400−T1)/5 minutes. A preferable lower limit of the holding time t1 is 10 minutes, and more preferably is 15 minutes. A preferable upper limit of the holding time t1 is F1-5 (mins), and more preferably is F1-10 (mins).

As described above, after being held for the holding time t1 at the heat treatment temperature T1, the intermediate steel material is rapidly cooled. By this means, the occurrence of a situation in which alloying elements which were dissolved by the heat treatment precipitate during cooling is suppressed. The rapid cooling is, for example, water cooling or oil cooling. As a water cooling method, the steel material may be immersed in a water tank for cooling, or the steel material may be rapidly cooled by shower water cooling or mist cooling.

In the case of producing the steel material by performing hot working, the heat treatment process may be performed on the steel material immediately after completion of hot working. For example, the steel material temperature (finishing temperature) immediately after completion of hot working may be set within a range of 950 to 1200° C., and after holding the steel material for the holding time t1, the steel material may be rapidly cooled. In this case, an effect is obtained that is equal to the effect of the heat treatment using a heat treatment furnace that is described above. In the case of rapidly cooling the steel material immediately after the completion of hot working, the heat treatment temperature T1 of the heat treatment process corresponds to the temperature (° C.) of the intermediate steel material immediately after hot working.

[Cold Working Process]

In the cold working process, the intermediate steel material after the heat treatment process is subjected to cold working. The cold working is, for example, cold drawing, cold forging or cold rolling. For example, in a case where the steel material is a pipe or a steel bar, cold drawing is performed. In a case where the steel material is a steel sheet, cold rolling is performed.

An area reduction ratio RR in the cold working process is made 15.0% or more. The area reduction ratio RR (%) in the cold working process is defined by the following equation.

Area reduction ratio RR=(1−(cross-sectional area of intermediate steel material after completion of cold working in cold working process/cross-sectional area of intermediate steel material before cold working process))×100

Here, the term "cross-sectional area of intermediate steel material" means the area ($mm^2$) of a cross section perpendicular to the longitudinal direction (axial direction) of the intermediate steel material.

In a case where the area reduction ratio RR in the cold working process is less than 15.0%, the dislocation cell structure ratio will be less than 50%. Consequently, a sufficiently high strength will not be obtained. Therefore, the area reduction ratio RR in the cold working process is set to 15.0% or more. A preferable lower limit of the area reduction ratio RR is 18.0%, more preferably is 19.0%, and further preferably is 20.0%.

The upper limit of the area reduction ratio RR is not particularly limited. However, if the area reduction ratio is more than 80.0%, the effect of increasing the strength will be saturated. Therefore, a preferable upper limit of the area reduction ratio RR is 80.0%. A further preferable upper limit of the area reduction ratio RR is 75.0%, and more preferably is 70.0%. Note that, the working direction in the cold working process (cold drawing or cold rolling) is a single direction. For example, in a case where cold rolling is performed from a plurality of directions, cell wall regions 101 that were formed by performing cold rolling in one direction will be destroyed by cold rolling in another direction. As a result, a dislocation cell structure will not be sufficiently formed. Therefore, in the present embodiment, the direction of cold working is a single direction.

By performing the above production processes, an austenitic stainless steel material can be produced that has the aforementioned chemical composition, and in which the austenite grain size No. determined in accordance with ASTM E112 is within a range of 5.0 to less than 8.0, the dislocation cell structure ratio is within a range of 50 to less than 80%, and the number density of precipitates with a long axis of 1.0 μm or more is 5.0 per 0.2 $mm^2$ or less.

Note that, the production method described above is one example of a method for producing the austenitic stainless steel material of the present embodiment. Therefore, the austenitic stainless steel material of the present embodiment may be produced by another production method as long as the austenitic stainless steel material has the aforementioned chemical composition and the austenite grain size No. determined in accordance with ASTM E112 is within a range of 5.0 to less than 8.0, the dislocation cell structure ratio is within a range of 50 to less than 80%, and the number density of precipitates with a long axis of 1.0 μm or more is 5.0 per 0.2 $mm^2$ or less. The production method described above is a favorable example of a method for producing the austenitic stainless steel material of the present embodiment.

EXAMPLES

The advantageous effects of the austenitic stainless steel material of the present embodiment are described more specifically hereunder by way of examples. The conditions adopted in the following examples are one example of conditions which are employed for confirming the workability and advantageous effects of the austenitic stainless steel material of the present embodiment. Accordingly, the austenitic stainless steel material of the present embodiment is not limited to this one example of the conditions.

Austenitic stainless steels having the chemical compositions shown in Table 1 were melted in a 180-kg vacuum melting furnace to produce ingots.

TABLE 1

| Steel | Chemical Composition (unit is mass %, the balance is Fe and impurities) | | | | | | | | | | |
|---|---|---|---|---|---|---|---|---|---|---|---|
| No. | C | Si | Mn | Cr | Ni | Mo | P | S | Al | N | Cu |
| A | 0.021 | 0.44 | 2.10 | 17.26 | 13.20 | 1.71 | 0.016 | 0.022 | ≤0.002 | 0.043 | — |
| C | 0.018 | 0.44 | 1.97 | 16.59 | 17.36 | 1.90 | 0.023 | 0.018 | ≤0.002 | 0.028 | — |
| D | 0.022 | 0.45 | 1.96 | 17.44 | 20.17 | 1.77 | 0.024 | 0.016 | ≤0.002 | 0.020 | — |
| E | 0.021 | 0.42 | 2.78 | 13.00 | 13.81 | 1.84 | 0.009 | 0.020 | ≤0.002 | 0.022 | — |
| F | 0.019 | 0.46 | 2.32 | 23.20 | 13.39 | 1.70 | 0.010 | 0.017 | ≤0.002 | 0.045 | — |
| H | 0.023 | 0.47 | 4.86 | 17.74 | 13.42 | 1.89 | 0.005 | 0.011 | ≤0.002 | 0.036 | — |
| I | 0.025 | 0.43 | 2.84 | 16.89 | 13.27 | 1.02 | 0.008 | 0.010 | ≤0.002 | 0.025 | — |
| J | 0.019 | 0.44 | 2.66 | 17.50 | 13.77 | 4.48 | 0.009 | 0.013 | ≤0.002 | 0.030 | — |
| K | 0.015 | 0.47 | 1.81 | 17.30 | 12.90 | 2.10 | 0.026 | 0.001 | ≤0.002 | 0.032 | 0.26 |

Each ingot was subjected to hot forging and hot rolling to produce a steel sheet (intermediate steel material) of 200 mm in width×20 mm in thickness. Note that, the heating temperature T0 (° C.) at the time of hot forging, and the holding time t0 (mins) at the heating temperature T0 (° C.) for the respective test numbers (see Table 2) were as shown in Table 2. The reduction of area during hot forging was 65% for each test number. The thus-produced intermediate steel material of each test number was subjected to a heat treatment process. The heat treatment temperature T1, and the holding time t1 (mins) at the heat treatment temperature T1 (° C.) in the heat treatment process were as shown in Table 2. The steel sheet was water-cooled immediately after extraction from the heat treatment furnace after the holding time elapsed. The cooling rate was, for example, 100° C./sec or more.

TABLE 2

| Test No. | Steel No. | Heating Temperature T0 (° C.) | Holding Time t0 (mins) | Heat Treatment Temperature T1 (° C.) | Holding Time t1 (mins) | F1 | Area Reduction Ratio RR (%) | Grain Size No. | Dislocation Cell Structure Ratio (%) | Coarse Precipitate Number Density (precipitates per 0.2 $mm^2$) | Tensile Strength (MPa) | Relative Reduction of Area after Rupture Evaluation |
|---|---|---|---|---|---|---|---|---|---|---|---|---|
| 1 | A | 1050 | 30 | 1150 | 30 | 50 | 20.0 | 6.1 | 60 | 0.7 | 806 | ○ |
| 2 | A | 1050 | 30 | 1150 | 30 | 50 | 50.0 | 6.2 | 70 | 1.3 | 1091 | ○ |
| 3 | A | 1050 | 30 | 1150 | 30 | 50 | 80.0 | 6.1 | 77 | 4.0 | 1204 | ○ |
| 4 | A | 1050 | 30 | 1050 | 60 | 70 | 20.0 | 6.0 | 57 | 2.3 | 801 | ○ |
| 5 | C | 1050 | 30 | 1150 | 30 | 50 | 20.0 | 6.3 | 67 | 1.0 | 810 | ○ |

TABLE 2-continued

| Test No. | Steel No. | Heating Temperature T0 (° C.) | Holding Time t0 (mins) | Heat Treatment Temperature T1 (° C.) | Holding Time t1 (mins) | F1 | Area Reduction Ratio RR (%) | Grain Size No. | Dislocation Cell Structure Ratio (%) | Coarse Precipitate Number Density (precipitates per 0.2 $mm^2$) | Tensile Strength (MPa) | Relative Reduction of Area after Rupture Evaluation |
|---|---|---|---|---|---|---|---|---|---|---|---|---|
| 6 | D | 1050 | 30 | 1150 | 30 | 50 | 20.0 | 6.1 | 73 | 2.3 | 823 | ○ |
| 7 | H | 1050 | 30 | 1150 | 30 | 50 | 20.0 | 6.1 | 57 | 4.3 | 802 | ○ |
| 8 | J | 1050 | 30 | 1150 | 30 | 50 | 20.0 | 6.2 | 67 | 0.3 | 815 | ○ |
| 9 | E | 1050 | 30 | 1150 | 30 | 50 | 20.0 | 6.1 | 43 | 1.0 | 812 | X |
| 10 | F | 1050 | 30 | 1150 | 30 | 50 | 20.0 | 6.5 | 50 | 7.7 | 876 | X |
| 11 | I | 1050 | 30 | 1150 | 30 | 50 | 20.0 | 5.8 | 47 | 1.3 | 795 | X |
| 12 | A | 1050 | 30 | 1250 | 30 | 30 | 20.0 | 2.1 | 7 | 0 | 703 | ○ |
| 13 | A | 1050 | 30 | 850 | 30 | 110 | 20.0 | 7.6 | 50 | 5.3 | 830 | X |
| 14 | A | 1050 | 30 | 1150 | 60 | 50 | 20.0 | 5.7 | 47 | 0.3 | 781 | ○ |
| 15 | A | 1050 | 30 | 1150 | 30 | 50 | 10.0 | 6.2 | 47 | 0.3 | 695 | ○ |
| 16 | A | 1050 | 30 | 1150 | 30 | 50 | 0 | 6.1 | 0 | 0.3 | 575 | ○ |
| 17 | K | 1050 | 30 | 1150 | 30 | 50 | 20 | 6.0 | 77 | 2.3 | 816 | ○ |

A cold working process was performed on the intermediate steel material after the heat treatment process. Cold rolling was performed as the cold working process. The area reduction ratios RR in the cold working process were as shown in Table 2. Note that, in Test Number 16, a cold working process was not performed. Therefore, the area reduction ratio RR in a cold working process for Test Number 16 was 0%. Note that, the rolling direction in the cold rolling was a single direction. Austenitic stainless steel materials (steel sheets) were produced by the above production processes.

[Evaluation Tests]

[Grain Size Number Measurement Test]

As illustrated in FIG. 8, the sheet thickness at a cross section perpendicular to the longitudinal direction of the austenitic stainless steel material was defined as "t" (mm). A t/2 position in the sheet thickness direction from the top surface was defined as a sampling position P1. A t/4 position in the sheet thickness direction from the top surface was defined as a sampling position P2. A t/4 position in the sheet thickness direction from the bottom surface was defined as a sampling position P3. Samples P1 to P3 were collected from the sampling positions P1 to P3. A cross section perpendicular to the longitudinal direction of the austenitic stainless steel material was adopted as the surface to be examined for each of the samples P1 to P3. The sample P1 was collected in a manner so that the center position of the surface to be examined approximately corresponded to the t/2 position. The sample P2 was collected in a manner so that the center position of the surface to be examined approximately corresponded to the t/4 position. The sample P3 was collected in a manner so that the center position of the surface to be examined approximately corresponded to the t/4 position.

The surface to be examined of each of the samples P1 to P3 was mirror-polished. Each surface to be examined that was mirror-polished was then subjected to etching using a mixed acid (solution in which hydrochloric acid and nitric acid were mixed at a ratio of 1:1) to reveal austenite grain boundaries. Structural observation of the surface to be examined of the respective samples P1 to P3 was performed using an optical microscope. The magnification of the optical microscope for the structural observation was set to ×100. An arbitrary three visual fields were selected on the surface to be examined of each of the samples P1 to P3. The size of each visual field was set to 1000 μm×1000 μm. In each visual field, the austenite grain size No. was measured in accordance with ASTM E112. The arithmetic mean value of the austenite grain size Nos. obtained in the nine visual fields (three visual fields in each of the samples P1 to P3) was defined as the austenite grain size No. of the austenitic stainless steel material. The obtained austenite grain size Nos. are shown Table 2.

[Dislocation Cell Structure Ratio Calculation Test]

As illustrated in FIG. 8, taking the sheet thickness at a cross section perpendicular to the longitudinal direction of the austenitic stainless steel material as "t" (mm), samples P1 to P3 for dislocation cell structure observation were collected from a sampling position P1 that was a t/2 position in the sheet thickness direction from the top surface, a sampling position P2 that was a t/4 position in the sheet thickness direction from the top surface, and a sampling position P3 that was a t/4 position in the sheet thickness direction from the bottom surface. A cross section perpendicular to the longitudinal direction of the austenitic stainless steel material was adopted as the surface to be examined of the respective samples P1 to P3. Wet polishing was performed until the thickness of each sample became 30 μm. After the wet polishing, the respective samples P1 to P3 were subjected to electropolishing using a mixed solution of perchloric acid (10 vol. %) and ethanol (90 vol. %) to prepare thin film samples P1 to P3. The surface to be examined of each of the thin film samples P1 to P3 was subjected to structural observation using a TEM. Specifically, arbitrary 10 visual fields on the surface to be examined of the respective thin film samples P1 to P3 (10 visual fields for the thin film sample P1, 10 visual fields for the thin film sample P2, and 10 visual fields for the thin film sample P3) were subjected to the TEM observation. The size of each visual field was set to 4.2 μm×4.2 μm. The acceleration voltage during the TEM observation was set to 200 kV. Grains that were observable using an incident electron beam in a <110> direction were taken as the observation target. A bright field image was generated in each visual field.

The bright field image of each visual field was used to determine whether or not the visual field was a dislocation cell structure by the following method. For each of the obtained bright field images, a histogram showing the frequency of pixel values (0 to 255) was generated, and a median value of the histogram was determined. Note that, the number of picture elements of the bright field image of each visual field was 117,306 pixels. The respective bright field images were then binarized by adopting the median value as a threshold value. In the binarized image, low-density dislocation regions 102 that were white-colored regions were identified. The outer extent of each low-density dislocation region 102 was defined, and the area of each low-density dislocation region 102 was determined. Further, each low-density dislocation region 102 having an area of 0.20 $\mu m^2$ or more was recognized as a "dislocation cell". The number of dislocation cells (low-density dislocation regions 102 having an area of 0.20 $\mu m^2$ or more) in each visual field (4.2 μm×4.2 μm) was determined. Further, in the respective visual fields, if nine or more dislocation cells were present, the visual field in question was recognized as being a visual field in which a dislocation cell structure was formed. The number of visual fields in which a dislocation cell structure was formed among the observed 30 visual fields was determined. The dislocation cell structure ratio (%) was then defined by the following equation.

Dislocation cell structure ratio=number of visual fields in which a dislocation cell structure is formed/total number of visual fields×100

The obtained dislocation cell structure ratios are shown in Table 2.

[Test to Measure Number Density of Coarse Precipitates]

The number density of coarse precipitates was measured by the following method. Samples for measuring the number density of coarse precipitates were collected from the aforementioned sampling positions P1 to P3.

A cross section perpendicular to the longitudinal direction of the austenitic stainless steel material was adopted as the surface to be examined of the respective samples P1 to P3. The surface to be examined was mirror-polished. Each of the samples P1 to P3 after mirror-polishing was subjected to etching using a mixed acid (solution in which hydrochloric acid and nitric acid were mixed at a ratio of 1:1) to reveal austenite grain boundaries and precipitates. After etching, one visual field of the surface to be examined was observed using a backscattered electron image utilizing an SEM. The visual field size was set to 400 μm×500 μm. The long axis of precipitates in the visual field was measured. Specifically, the longest straight line among straight lines connecting any two points at the interface between the precipitate and the parent phase (austenite) was defined as the long axis (μm). Among the precipitates, precipitates with a long axis of 1.0 μm or more were identified as "coarse precipitates". The number of identified coarse precipitates was determined. The number density of coarse precipitates (per 0.2 $mm^2$) in the respective samples P1 to P3 was determined based on the obtained number of coarse precipitates and the visual field area (0.2 $mm^2$). Then, the arithmetic mean value of the three number densities was defined as the number density of coarse precipitates (per 0.2 $mm^2$). The number density of coarse precipitates obtained for each test number is shown in Table 2.

[Slow Strain Rate Test]

A slow strain rate test (SSRT) was performed on the steel sheet of each test number. Specifically, a plurality of round bar tensile test specimens were prepared from the center position of the sheet thickness of the steel sheet. The diameter of the parallel portion of the round bar tensile test specimen was 3.0 mm, and the parallel portion was parallel to the longitudinal direction (corresponds to rolling direction) of the steel sheet. The central axis of the parallel portion approximately coincided with the center position of the sheet thickness of the steel sheet. The surface of the parallel portion of each round bar tensile test specimen was polished with #150, #400, and #600 emery paper in that order, and thereafter degreased with acetone. Using each obtained round bar tensile test specimen, a tensile test was carried out at normal temperature in the atmosphere at a strain rate of $3.0\times10^{-5}$/sec, and the reduction of area after rupture (elongation after rupture; unit is %) and the tensile strength (MPa) were obtained. The obtained tensile strengths are shown in Table 2.

In addition, using another round bar tensile test specimen, a tensile test was carried out in hydrogen gas at 90 MPa at a strain rate of $3.0\times10^{-5}$/sec, and the reduction of area after rupture (elongation after rupture; unit is %) was obtained. The relative reduction of area after rupture (%) of the respective test numbers was determined using the following equation.

Relative reduction of area after rupture=reduction of area after rupture in hydrogen gas at 90 MPa/reduction of area after rupture at normal temperature in the atmosphere×100

If the obtained relative reduction of area after rupture was 90.0% or more, the relevant round bar tensile test specimen was determined as being excellent in hydrogen brittleness resistance ("○" in the "Relative Reduction of Area after Rupture Evaluation" column in Table 2). On the other hand, if the obtained relative reduction of area after rupture was less than 90.0%, it was determined that the hydrogen brittleness resistance was low ("x" in the "Relative Reduction of Area after Rupture Evaluation" column in Table 2).

[Test Results]

The test results are shown in Table 2. The chemical composition of each of Test Numbers 1 to 8 and 17 was appropriate, and the production method was also appropriate. Therefore, in the austenitic stainless steel material, the austenite grain size No. determined in accordance with ASTM E112 was within the range of 5.0 to less than 8.0. In addition, the dislocation cell structure ratio was within the range of 50 to less than 80% for each of these test numbers. Furthermore, the coarse precipitate number density was 5.0 per 0.2 $mm^2$ or less for each of these test numbers. As a result, in Test Numbers 1 to 8, the tensile strength was 800 MPa or more, and thus a high tensile strength was obtained. In addition, the relative reduction of area after rupture was 90.0% or more, indicating excellent hydrogen brittleness resistance.

On the other hand, in Test Number 9 the content of Cr was too low. Therefore, the relative reduction of area after rupture was less than 90.0%, and the hydrogen brittleness resistance was low.

In Test Number 10, the content of Cr was too high. Therefore, the number density of coarse precipitates was more than 5.0 per 0.2 $mm^2$. As a result, the relative reduction of area after rupture was less than 90.0%, and the hydrogen brittleness resistance was low. It is considered that this was because an excessive amount of Cr carbides was formed, and served as starting points for hydrogen cracking.

In Test Number 11, the content of Mo was too low. Therefore, the dislocation cell structure ratio was less than 50%. Consequently, the tensile strength was less than 800 MPa. In addition, the relative reduction of area after rupture was less than 90.0%, and the hydrogen brittleness resistance was low.

In Test Number 12, although the chemical composition was appropriate, the heat treatment temperature T1 in the heat treatment process was too high. Consequently, the austenite grain size No. was a low number that was less than 5.0. In addition, the dislocation cell structure ratio was less than 50%. As a result, the tensile strength was less than 800 MPa.

In Test Number 13, although the chemical composition was appropriate, the heat treatment temperature T1 in the heat treatment process was too low. Therefore, the number density of coarse precipitates was more than 5.0 per 0.2 $mm^2$. As a result, the relative reduction of area after rupture was less than 90.0%, and the hydrogen brittleness resistance was low.

In Test Number 14, although the chemical composition was appropriate, the holding time t1 in the heat treatment process was more than F1. Consequently, the dislocation cell structure ratio was less than 50%. Therefore, the tensile strength was less than 800 MPa.

In Test Number 15, the area reduction ratio RR in the cold working process was too low. Further, in Test Number 16, a cold working process was not performed. Consequently, in Test Numbers 15 and 16, the dislocation cell structure ratio was less than 50%. Therefore, the tensile strength was less than 800 MPa.

An embodiment of the present invention has been described above. However, the foregoing embodiment is merely an example for implementing the present invention. Accordingly, the present invention is not limited to the above embodiment, and the above embodiment can be appropriately modified within a range that does not deviate from the gist of the present invention.

REFERENCE SIGNS LIST

101 Cell Wall Region
102 Low-density Dislocation Region

The invention claimed is:

1. An austenitic stainless steel material, having a chemical composition consisting of, by mass %,
C: 0.100% or less,
Si: 1.00% or less,
Mn: 5.00% or less,
Cr: 15.00 to 22.00%,
Ni: 10.00 to 21.00%,
Mo: 1.20 to 4.50%,
P: 0.050% or less,
S: 0.050% or less,
Al: 0.100% or less,
N: 0.100% or less, and
Cu: 0 to 0.70%,
with the balance being Fe and impurities,
wherein:
an austenite grain size No. determined in accordance with ASTM E112 is within a range of 5.0 to less than 8.0, and
in a cross section perpendicular to a longitudinal direction of the austenitic stainless steel material, a dislocation cell structure ratio is within a range of 50 to less than 80%, and a number density of precipitates with a long axis of 1.0 μm or more is 5.0 per 0.2 $mm^2$ or less.

2. The austenitic stainless steel material according to claim 1, wherein:
the austenite grain size No. is 5.8 or more to less than 8.0.

3. The austenitic stainless steel material according to claim 1, wherein:
the dislocation cell structure ratio is 55% or more to less than 80%.

4. The austenitic stainless steel material according to claim 2, wherein:
the dislocation cell structure ratio is 55% or more to less than 80%.

5. The austenitic stainless steel material according to claim 1, wherein:
the number density of precipitates with a long axis of 1.0 μm or more is 4.5 per 0.2 $mm^2$ or less.

6. The austenitic stainless steel material according to claim 2, wherein:
the number density of precipitates with a long axis of 1.0 μm or more is 4.5 per 0.2 $mm^2$ or less.

7. The austenitic stainless steel material according to claim 3, wherein:
the number density of precipitates with a long axis of 1.0 μm or more is 4.5 per 0.2 $mm^2$ or less.

8. The austenitic stainless steel material according to claim 4, wherein:
the number density of precipitates with a long axis of 1.0 μm or more is 4.5 per 0.2 $mm^2$ or less.

9. The austenitic stainless steel material according to claim 1, wherein the chemical composition contains:
Cu: 0.01 to 0.70%.

10. The austenitic stainless steel material according to claim 2, wherein the chemical composition contains:
Cu: 0.01 to 0.70%.

11. The austenitic stainless steel material according to claim 3, wherein the chemical composition contains:
Cu: 0.01 to 0.70%.

12. The austenitic stainless steel material according to claim 4, wherein the chemical composition contains:
Cu: 0.01 to 0.70%.

13. The austenitic stainless steel material according to claim 5, wherein the chemical composition contains:
Cu: 0.01 to 0.70%.

14. The austenitic stainless steel material according to claim 6, wherein the chemical composition contains:
Cu: 0.01 to 0.70%.

15. The austenitic stainless steel material according to claim 7, wherein the chemical composition contains:
Cu: 0.01 to 0.70%.

16. The austenitic stainless steel material according to claim 8, wherein the chemical composition contains:
Cu: 0.01 to 0.70%.

* * * * *